United States Patent [19]

Foreman et al.

[11] Patent Number: 4,808,794

[45] Date of Patent: Feb. 28, 1989

[54] THERMOSTATICALLY CONTROLLED ELECTRIC IMMERSION HEATING ELEMENT

[75] Inventors: Joseph F. Foreman, Hannibal; John S. Rhoads, New London, both of Mo.

[73] Assignee: Watlow Industries, Inc., Hannibal, Mo.

[21] Appl. No.: 72,106

[22] Filed: Jul. 10, 1987

[51] Int. Cl.[4] ..... H05B 3/82; H05B 1/02

[52] U.S. Cl. ..... 219/331; 219/316; 219/318; 219/437

[58] Field of Search ..... 219/306, 308, 316, 318, 219/319, 320–323, 327, 331, 335, 336, 523, 437

[56] References Cited

U.S. PATENT DOCUMENTS

| | | | |
|---|---|---|---|
| 1,710,196 | 4/1929 | Simon | 219/318 X |
| 2,134,675 | 10/1938 | Shroyer | 219/437 |
| 2,481,384 | 9/1949 | Blackwell | 219/322 X |
| 2,524,954 | 10/1950 | Best | 219/316 X |
| 3,134,008 | 5/1964 | Finn | 219/316 X |
| 3,413,440 | 11/1968 | Drugmand | 219/437 X |

FOREIGN PATENT DOCUMENTS

| | | | |
|---|---|---|---|
| 1565505 | 3/1970 | Fed. Rep. of Germany | 219/331 |
| 2016655 | 10/1971 | Fed. Rep. of Germany | 219/331 |
| 591796 | 9/1977 | Switzerland | 219/331 |
| 562997 | 7/1944 | United Kingdom | 219/437 |
| 805440 | 12/1958 | United Kingdom | 219/316 |
| 1390731 | 4/1975 | United Kingdom | 219/437 |

OTHER PUBLICATIONS

Watlow Industries, *Firebar Heating Elements Application Guide and Stock List*, pp. 1–6, 1983, Hannibal, MO.

*Primary Examiner*—Anthony Bartis

*Attorney, Agent, or Firm*—Senniger, Powers, Leavitt and Roedel

[57] ABSTRACT

A thermostatically controlled electric immersion heating element for heating fluid contained in a dishwasher having a vertical wall includes an elongated heating element of flattened configuration in transverse cross section having opposing generally parallel wide faces and opposite narrow side edges connecting the faces. The heating element is mounted in cantilever fashion from the vertical wall by a mounting flange in an operating position in which a reach of the heating element extends a maximum distance from the flange with the wide faces disposed in vertical planes. A tubular housing is secured in continuous heat transfer contact with substantially the entire length of the upper side edge of the heating element reach and contains a temperature sensing element for controlling the operation of the heating element in response to the temperature of the heating element.

4 Claims, 1 Drawing Sheet

TEMP SENSOR 27
TEMP CONTROL 31

THERMOSTATICALLY CONTROLLED ELECTRIC IMMERSION HEATING ELEMENT

BACKGROUND OF THE INVENTION

This invention relates generally to tubular electric heaters and, more particularly, to a tubular electric heater of flattened cross-sectional configuration which is adapted to be immersed in a fluid to heat the fluid, and which is equipped for reliable sensing of the temperature of the heating element of the electric heater to prevent overheating of the heater.

Immersible tubular electric heaters have a multitude of different uses, as in commercial dishwashers, for example, where one or more heaters are mounted to project generally horizontally from a wall of the dishwasher for heating liquid in the dishwasher. In this application, tubular heaters having a round cross-sectional shape are often used, and energization of the heater is controlled by a heat sensing element which senses the temperature of the heater, the arrangement being such that the element is adapted to deenergize the heater (and thus prevent damage to the heater) in the event the temperature of the heater rises to an excessive level, as may occur when the liquid in the dishwasher drops to a level below the heater.

One such sensing element which has been used is a thermocouple wire or liquid or vapor filled capillary element wrapped around the heater in helical fashion from adjacent one end of the heater to the other. This design presents a problem, however, in that the outer end of the tubular heater tends to droop or sag when heated, so that as the level of the liquid in the dishwasher drops, the portion of the heater adjacent the wall becomes exposed prior to the portion of the heater remote from the wall. Because the sensing element may not sense the rising temperature of the exposed inner portion of the heater, there is a serious risk of overheating and consequent damage to the heater.

Moreover, even if the heater does not droop or sag, only portions of the sensing element are in contact with the upper surface of the heater due to the element's wrapped configuration. As the level of the liquid in the dishwasher drops, the upper portions of the sensing element become exposed prior to the lower portions. This creates a further risk of overheating the heater as the sensing element may not sense the rising temperature of the exposed upper portion of the heater.

SUMMARY OF THE INVENTION

Among the several objects of this invention may be noted the provision of an improved electric heater for heating fluids, such as liquid in a dishwasher; the provision of such a heater which has a flattened cross-sectional shape and which is equipped for reliable sensing of the temperature of the element to prevent overheating of the heater; the provision of such a heater equipped for reliable sensing of the temperature of the upper surface of the element; the provision of such a heater which is relatively rigid to resist sagging or drooping when heated; the provision of such a heater which is designed for use with a relatively simple and inexpensive temperature sensing element; and the provision of such a heater which is relatively simple in design for economical manufacture.

In general, an electric heater of this invention comprises an elongate heating element of flattened configuration in transverse cross section having opposing generally parallel wide faces and opposite narrow side edges connecting the faces, flange means secured to the heating element for mounting the heating element on a generally vertical wall in an operating position in which at least one reach of the heating element extends as a cantilever generally horizontally from the wall a maximum distance from the flange means with the opposing wide faces of the heating element disposed in generally vertical planes, a tubular housing, a temperature sensing element in the housing for controlling the operation of the heating element in response to the temperature of the heating element, and means for securing said housing in heat transfer contact with the one reach of the heating element, the heat transfer contact being substantially continuous along substantially the entire length of the reach and along one side edge of the reach constituting its upper edge when the heating element is in the operating position.

Other objects and features will be in part apparent and in part pointed out hereinafter.

DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4:
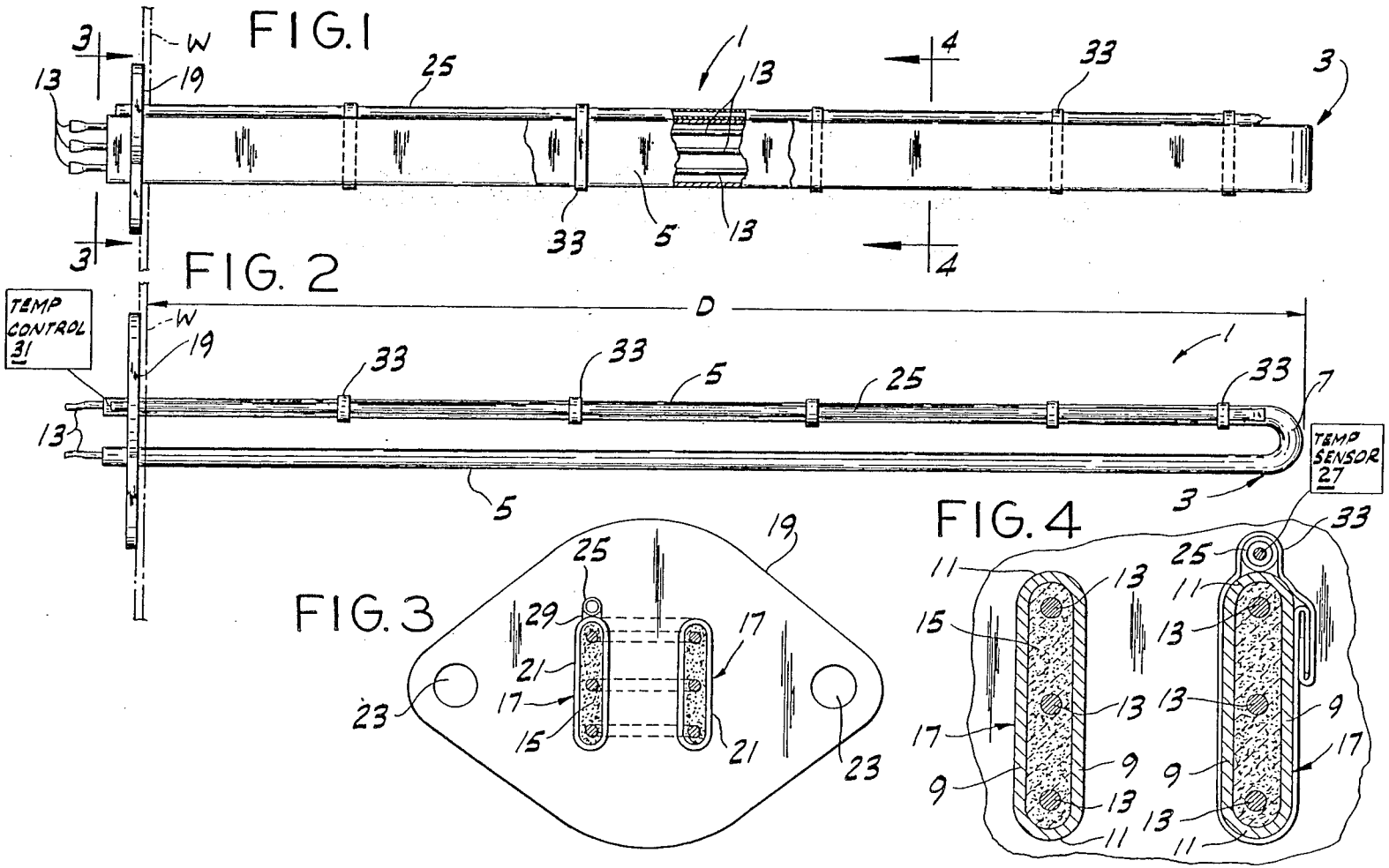
FIG. 1 is a side elevational view of an electric heater of this invention mounted on a generally vertical wall, portions of the heater being broken away to illustrate details.
FIG. 2 is a top plan view of FIG. 1.
FIG. 3 is an enlarged left end sectional view taken on line 3—3 of FIG. 1.
FIG. 4 is an enlarged sectional view taken on line 4—4 of FIG. 1.

Referring now to the drawings, an electric heater of the present invention is generally indicated by reference numeral 1. The heater is shown mounted on a vertical wall W in a position wherein it extends generally horizontally from the wall. The wall may be, for example, the wall of a dishwasher and the heater may be used for heating liquid in the dishwasher. However, it will be understood that the heater may have other applications.

More specifically, the heater comprises an elongate heating element generally designated 3 bent into a sinuous shape to have a plurality of spaced apart generally parallel straight reaches 5 and a bend 7 connecting each pair of adjacent reaches. As illustrated in FIG. 2, the heating element 3 is generally U-shaped having two generally parallel reaches 5 connected by one semicircular bend 7, but it is contemplated that the heater may have additional reaches and bends without departing from the scope of this invention.

The heating element 3 is of flattened configuration in transverse cross section (FIG. 4) and comprises a tubular metal sheath generally designated 17 having opposing generally parallel wide faces 9 and opposite generally U-shaped narrow side edges 11 connecting the parallel faces. Spaced apart generally parallel electric resistance wires, each designated 13, extend longitudinally throughout the length of the heating element 3 and are surrounded by a suitable dielectric material 15 (e.g., magnesium oxide powder), which fills the spaces between the resistance wires and inside surface of the sheath 17. The resistance wires 13 project endwise from opposite ends of the element 3 for connection to a suitable power source.

Means comprising a mounting flange or bracket indicated at 19 is provided for mounting the heating element 3 in its FIG. 1 operative position in which it extends as a cantilever generally horizontally inwardly into the tank through the wall W a maximum distance D with the opposing flattened faces 9 of the heating element 3 disposed in generally vertical planes. The ends of the heating element are suitably secured (as by welds) in vertical slots 21 in the mounting flange 19. The flange has holes 23 therein for attachment of the flange by suitable fasteners to the wall W.

In accordance with this invention, a slender tubular housing 25 (sometimes referred to as a thermowell) is disposed along the upper side edge 11 of one reach 5 of the heating element 3 and has a length approximately equal to the distance D. The housing 25 is adapted for receiving a temperature sensing element 27 therein adapted to control the operation of the heating element in response to the temperature of the heating element. For example, the temperature sensing element may be a thermocouple wire element of suitable material or a vapor filled capillary of a mechanical thermostat. One end of the tubular housing 25 (its left end is viewed in FIG. 1) is open and sealingly secured (e.g., welded) in an extension 29 of slot 21 in the mounting flange, although it will be understood that the tubular housing could be secured in a separate hole adjacent slot 21 in the mounting flange. The other (right) end of the housing is closed. The temperature sensing element 27 extends throughout the length of the housing and projects endwise from the open end of the housing for connection to a suitable control device 31.

Means comprising a plurality of clamps 33 is provided for securing the tubular housing 25 in heat transfer contact with the upper edge 11 of one reach 5 the heating element 3, the contact being substantially continuous along substantially the entire length of the reach. These clamps 33 are spaced at intervals along the housing and may be of any type suitable for holding the housing 25 tight against the heating element 3. The clamps may be band clamps, for example, of flexible metal strapping adapted to be bent around the heating element 3 and the tubular housing 25 and locked in position by interlocking the ends of each clamp in overlapping relation, as illustrated in FIG. 4.

To install the heater 1 of this invention, the heating element 3 is mounted on the wall W in its operative position as shown in FIG. 1 with the clamps 33 installed to hold the housing 25 in close heat transfer contact with the heating element 3, and with the temperature sensing element 27 in position in housing 25. To complete the installation, the resistance wires 13 are connected to a suitable power source and the temperature sensing element to control device 31. In use, energization of the heat will heat the liquid in the dishwasher until such time as the temperature of the heating element as sensed by the temperature sensing device within housing 25 rises to a predetermined temperature, at which point the control device is operable to deenergize the heater to prevent overheating of the heater.

It will be observed that since the heating element 3 is mounted with its parallel faces 9 vertical (or only slightly off vertical), there will be very little, if any, vertical deflection (e.g., drooping or sagging) of the element toward its free end, which would otherwise occur if the heating element were round in cross-sectional shape. Thus, as the water level drops, the housing 25 and heating element 3 are exposed evenly along their entire lengths, the result being that the temperature sensed by the temperature sensing element 27 is representative of the temperature of the heating element over its entire length. This avoids the aforementioned problem associated with prior art heating devices which tend to deflect vertically (e.g., droop or sag). To prevent over-heating of the element 3, it is important that the temperature sensing element 27 sense the temperature of that portion of the heating element 3 which is exposed first as the water level drops. To ensure this, the mounting flange 19 may be rotated slightly in the plane of the wall to a position where the reach 5 of the heating element on which the housing 25 is mounted is higher than the other reach (or reaches) 5 of the element.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An electric heater for heating fluid, such as liquid in a dishwasher, comprising an elongate heating element of flattened configuration in transverse cross section having opposing generally parallel wide faces and opposite narrow side edges connecting the faces, flange means secured to said heating element for mounting the heating element on a generally vertical wall in an operating position in which at least one reach of said heating element extends as a cantilever generally horizontally from the wall a maximum distance from said flange means with the opposing wide faces of the heating element disposed in generally vertical planes, a tubular housing, a temperature sensing element in the housing for controlling the operation of the heating element in response to the temperature of the heating element, and means for securing said housing in heat transfer contact with one of said at least one reach of the heating element, said heat transfer contact being substantially continuous along substantially the entire length of the reach and along one side edge of the reach constituting its upper edge when the heating element is in said operating position.

2. An electric heater as set forth in claim 1 wherein said securing means comprises a plurality of clamps spaced at intervals along the housing.

3. An electric heater as set forth in claim 1 wherein said flange means comprises a mounting flange at one end of the heating element.

4. An electric heater as set forth in claim 1 wherein said heating element is bent into a sinuous shape, comprising a plurality of spaced-apart generally straight and parallel reaches and a bend connecting each pair of adjacent reaches, said housing being adapted to be secured along the side edge defining the upper edge of one of said generally parallel reaches when the heating element is in its operating position.

* * * * *